United States Patent [19]

Hopfensperger et al.

[11] Patent Number: 4,712,976

[45] Date of Patent: Dec. 15, 1987

[54] TANGENTIAL BLOWER

[75] Inventors: Reinhold Hopfensperger, Dietelskirchen; Klaus Taschner, Landshut, both of Fed. Rep. of Germany

[73] Assignee: Standard Elektrik Lorenz AG, Stuttgart, Fed. Rep. of Germany

[21] Appl. No.: 734,345

[22] Filed: May 14, 1985

[30] Foreign Application Priority Data

May 16, 1984 [DE] Fed. Rep. of Germany ..... 3418160

[51] Int. Cl.[4] ..... F04D 17/04; F04D 29/66

[52] U.S. Cl. ..... 415/54; 415/119; 415/DIG. 1; 415/208

[58] Field of Search ..... 415/54, 119, 182, 208, 415/219 C, 148, 209

[56] References Cited

U.S. PATENT DOCUMENTS

| | | | |
|---|---|---|---|
| 3,223,313 | 12/1965 | Kinsworthy | 415/143 |
| 3,295,750 | 1/1967 | Laing | 415/54 |
| 3,398,882 | 8/1968 | Zenkner | 415/54 |
| 3,695,775 | 10/1972 | Zenkner | 415/119 X |
| 4,073,338 | 2/1978 | Fujikake et al. | 415/54 X |
| 4,078,870 | 3/1978 | Keller et al. | 415/54 |

FOREIGN PATENT DOCUMENTS

| | | | |
|---|---|---|---|
| 1428130 | 11/1968 | Fed. Rep. of Germany . | |
| 1403553 | 7/1969 | Fed. Rep. of Germany . | |
| 2448362 | 4/1976 | Fed. Rep. of Germany . | |
| 2266016 | 3/1975 | France . | |
| 973475 | 10/1964 | United Kingdom . | |
| 503044 | 4/1976 | U.S.S.R. | 415/119 |

*Primary Examiner*—Robert E. Garrett
*Assistant Examiner*—Joseph M. Pitko
*Attorney, Agent, or Firm*—Spencer & Frank

[57] ABSTRACT

In a tangential blower, the vortex former is provided on the suction (intake) side with a sharp-edged interfering body at least extending over one-half of its length. The interfering body reduces siren like noise which would otherwise be produced.

5 Claims, 6 Drawing Figures

TANGENTIAL BLOWER

BACKGROUND OF THE INVENTION

The invention pertains to a tangential blower also known as crossflow fan or transverse flow blower.

Such a blower includes an impeller having blade edges extending parallel in relation to the axis of rotation, a deflector partially surrounding the impeller, a vortex former, and side members completely or partially surrounding the ends of the impeller.

Such tangential blowers are manufactured in large-scale production quantities for use in fan-forced heaters, air-conditioning systems, convectors, copiers, projectors, slide-in units for electric and electronic apparatus, and the like. They comprise a vortex former of simple construction, which has to provide formation of a continuous vortex flow; stabilization of the position of the vortex center; or deflection of the intake and outlet air of the blower.

Stable operating behaviour of a tangential blower within performance and noise values requires a stable position of the vortex center as well as a low loss of intake and outlet flow. In meeting these requirements the guiding effect of the vortex-former walls can play an important part. The reason for this is to be seen in that at a low to medium throttling of the tangential blower, the vortex center lies very close to the vortex former, so that on the suction side of the vortex former there are caused high speeds of the flow medium.

The tangential blower may produce a noise sounding like a siren which distinctly exceeds the usual noise. This siren sound is known to experts as the "peak blade frequency", the pitch of this sound can be calculated in accordance with the formula:

$$f=(n\cdot z)/60 \text{ (Hz)}$$

wherein n is the number of revolutions of the impeller per minute and z is the number of blades of the impeller.

The blades of the impeller moving past the vortex former responsible for causing this siren noise. These blades are at this point being subjected to an alternating stress at a small angle of rotation because the direction of flow is subjected to a rotation of about 180° and because of the transition from the surge or pressure space to the suction space which is a considerable difference in pressure.

Proposals have also already been made for reducing or avoiding the siren sound which, however, either do not have the desired effect especially in the cae of long tangential blowers, or else, in the case of short tangential blowers, effect a reduction of the air intake or output.

SUMMARY OF THE INVENTION

It is one object of the invention, therefore, to provide measures which reduce the siren sound in the case of a tangential blower operated at low to medium counter pressures, or suppress the noise completely in such a way that no changes result with respect to both the stable operating behaviour and the air intake or outlet. In addition thereto, the solution according to the invention shall be effective with any overall length of the tangential blower.

According to the invention, this object is achieved in that the vortex former in the proximity of its greatest approximation to the circumference of the impeller is provided on the suction side wih a sharp-edged interfering body extending over at least one half of its length.

BRIEF DESCRIPTION OF THE DRAWING

The invention will be better understood from a reading of the following detailed description in conjunction with the drawing in which.

DETAILED DESCRIPTION

Figure 1:
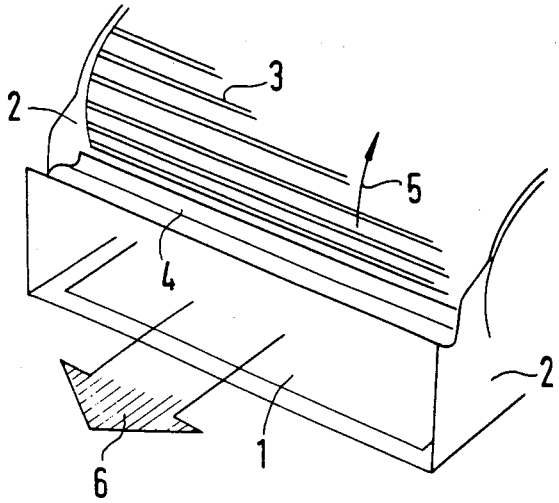
FIG. 1 is a perspective view of the front part of a tangential blower.

As shown in FIG. 1, a tangential blower consists of deflector 1, side members 2, impeller 3 and vortex former 4. When the impeller 3 is rotated by a motor, in the direction indicated by the arrow 5, then air is sucked-in from the space above the vortex former and blown out of the pressure space below the vortex former 4 in the direction as indicated by the arrow 6.

Figure 2:
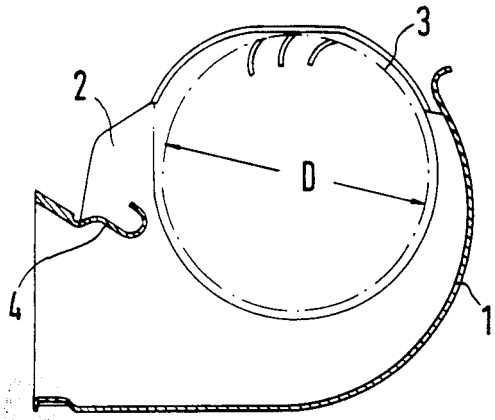
FIG. 2 is a cross sectional view of a tangential blower.

From the cross sectional view of the tangential blower as shown in FIG. 2, the deflector 1 can be very clearly recognized. The impeller is supposed to have the diameter D.

Figure 3:
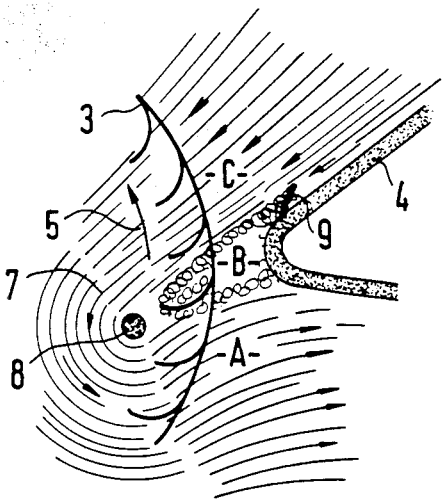
FIG. 3 shows the flow in a tangential blower within the area of the vortex former.

FIG. 3 shows the invention and the mode of operation thereof. The impeller 3 as rotated in the direction as indicated by the arrow 5, effects in the space C above the vortex former 4 as suction flow. Within the impeller 3 there exists the vortex flow 7 with the vortex center 8, and below the vortex former 4, in the space A, the flow is on the pressure side. As can be seen from FIG. 3, the blades of the impeller on their way from space A to space C, pass through the space B in which there exists a highly turbulent flow. This highly turbulent flow is caused by the interfering body 9 on the vortex former 4. This has the consequence, that the blade does not abruptly change from the pressure into the suction zone, but that the change over is effected gradually. Within the space B there may be effected a certain equalization of pressure between A and C. The highly turbulent flow within the space B is produced at a sharp edge of the interfering body 9 at which the flow starts to break off. As is apparent from the drawings, the interfering body 9 is non-rotatably fixed to the vortex former 4.

The interfering body 9 may be a ridge punched out of the vortex former 4 and which, either continuously or in sections, extends over the entire length of the vortex former 4. It is not absolutely necessary for the interfering body 9 to have the same length as the vortex former, but it should at least have a length corresponding to half the length of the vortex former. If the interfering body is shorter than the vortex former it may be located symmetrically with respect to the center line of the vortex former.

Instead of being punched out, the interfering body may also be placed on the vortex former.

Figure 4:
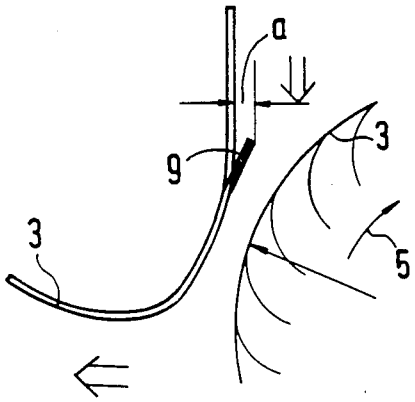
FIG. 4 shows one type of embodiment of the interfering body.
Figure 5:
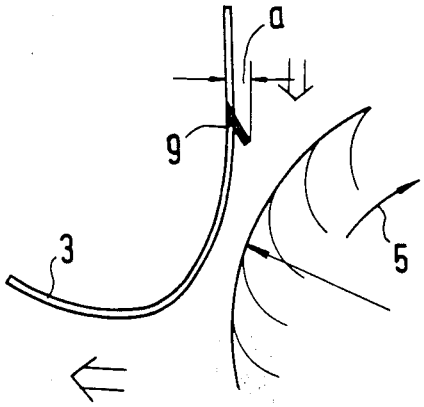
FIG. 5 shows a further embodiment of the interfering body.
Figure 6:
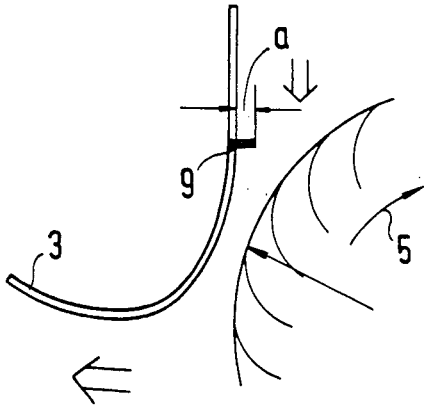
FIG. 6 shows a still further embodiment of the interfering body.

FIGS. 4 to 6 show three different types of embodiments of the interfering body 9. In the embodiment as shown in FIG. 4, the interfering body 9 is a ridge which is inclined (tilted) in the direction of the direction of rotation of the impeller (arrow 5). In the embodiment as shown in FIG. 5, the ridge is inclined (tilted) in opposition to the direction of rotation of the impeller, and in the type of embodiment in FIG. 6, the ridge is placed at a right angle in relation to the surface of the vortex former. The spacing A between the ends of the ridges and the surface of the vortex former should amount from 0.01 to 0.08 times the impeller diameter D.

Comparison measurements carried out on embodiments whose impeller had twenty blades and which were operated at rotational speeds ranging between 1,800 and 2,000 revolutions per minute, have proved that with the tangential blower whose vortex former was provided with the interfering body, the peak frequencies were very strongly reduced within the range from 600 to 700 Hz.

What is claimed is:

1. A tangential blower comprising:

an impeller having blade edges extending parallel in relation to the axis of rotation, a deflector partially surrounding said impeller, a vortex former and side members completely or partially surrounding the impeller ends, said vortex former in the proximity of its greatest approximation to the circumference of said impeller having on its suction side a sharp-edged interfering body non-rotatably fixed to said vortex former and extending at least over one half of the length of said vortex former, said interfering body acting to reduce noise by producing a zone of turbulence adjacent said vortex former between pressure and suction zones on either side of said vortex former through which said blade edges travel.

2. A tangential blower as in claim 1, wherein:

said interfering body includes a ridge standing vertically on the surface of the vortex former.

3. A tangential blower as in claim 1, wherein:

said interfering body includes a ridge on the surface of said vortex former, said ridge being inclined in opposition to the direction of rotation of the impeller.

4. A tangential blower as in claim 1, wherein:

said interfering body includes of a ridge on the surface of the vortex former, said ridge being inclined in the direction of rotation of the impeller.

5. A tangential blower as in claim 1, wherein:

the spacing between the end of said interfering body and the surface of said vortex former ranges between 0.01 and 0.08 times the diameter of said impeller.

* * * * *